United States Patent [19]

Plyhm

[11] Patent Number: 4,460,171

[45] Date of Patent: Jul. 17, 1984

[54] DEVICE FOR EXERCISING THE MUSCLES DETERMINING BODY POSTURE

[75] Inventor: Into Plyhm, Helsinki, Finland

[73] Assignee: Marenko Oy, Helsinki, Finland

[21] Appl. No.: 439,236

[22] Filed: Nov. 4, 1982

[51] Int. Cl.[3] ..... A63B 23/02

[52] U.S. Cl. ..... 272/94; 272/141

[58] Field of Search ..... 272/94, 93, 76, 77, 272/78, 141

[56] References Cited

U.S. PATENT DOCUMENTS

| | | | |
|---|---|---|---|
| 944,648 | 12/1909 | Austin | 272/77 |
| 2,319,109 | 5/1943 | Bullock | 272/93 |
| 3,427,021 | 2/1969 | Donato | 272/76 |
| 3,795,396 | 3/1974 | Kropelnitski | 272/93 |
| 3,927,879 | 12/1975 | Long | 272/76 |
| 4,239,209 | 12/1980 | Curchod | 272/76 |

OTHER PUBLICATIONS

Nautilus Instruction Manual Cover and p. 29, Jun. 1979, Published for Nautilus Sports/Medical Ind., DeLand, Florida.

*Primary Examiner*—Richard J. Johnson

*Attorney, Agent, or Firm*—A. A. Saffitz

[57] ABSTRACT

The device is composed of a rail adapted to be mounted on a wall and provided with a slider. A rocker arm pivotable against the action of a spring force is supported on the slider, a support adapted to be pressed against with the back of the head being mounted to the rocker arm. The device is suited for exercising the muscles determining body posture, which muscles do not generally get exerted in customary sport and gymnastics exercises.

4 Claims, 7 Drawing Figures

DEVICE FOR EXERCISING THE MUSCLES DETERMINING BODY POSTURE

BACKGROUND OF THE INVENTION

The present invention relates to a device for exercising the muscles determining body posture.

People suffer of bad body posture for a lot of different reasons, the most important of which being that they work in sitting position. This habit begins at school and often continues into adult life. Many hobbies, such as knitting, drawing, reading, and others are frequently carried out in the home with forwardly bent shoulders. Bad posture or other damages to health, such as back and shoulder pains may be the result.

Doing sports will not be of much help either, because the muscles responsible for body posture do not generally get exercised and will end up getting weak.

SUMMARY OF THE INVENTION

It is therefore an object of the invention, to create a device for exercising the muscles determining body posture, which do not get exerted in the course of ordinary exercises. This object is realized by means of the device of the invention, which comprises the features specified in the patent claims.

BRIEF DESCRIPTION OF THE DRAWINGS

The invention will be better understood and objects other than that set forth above will become apparent when consideration is given to the following detailed description thereof. Such description makes reference to the annexed drawings wherein.

DETAILED DESCRIPTION OF THE PREFERRED EMBODIMENT

Figures 3, 4:
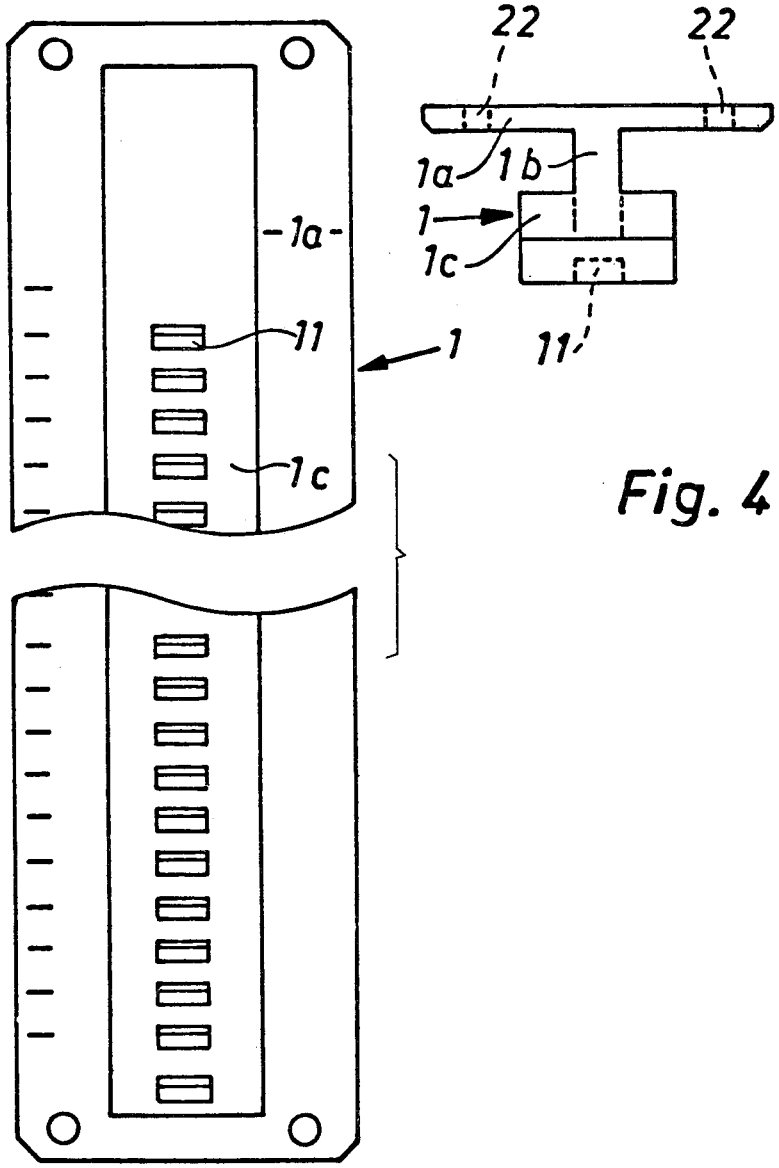
FIG. 3 is a front view of the mounting and guide rails.
FIG. 4 is an end view of the rails of FIG. 3.
Figure 5:
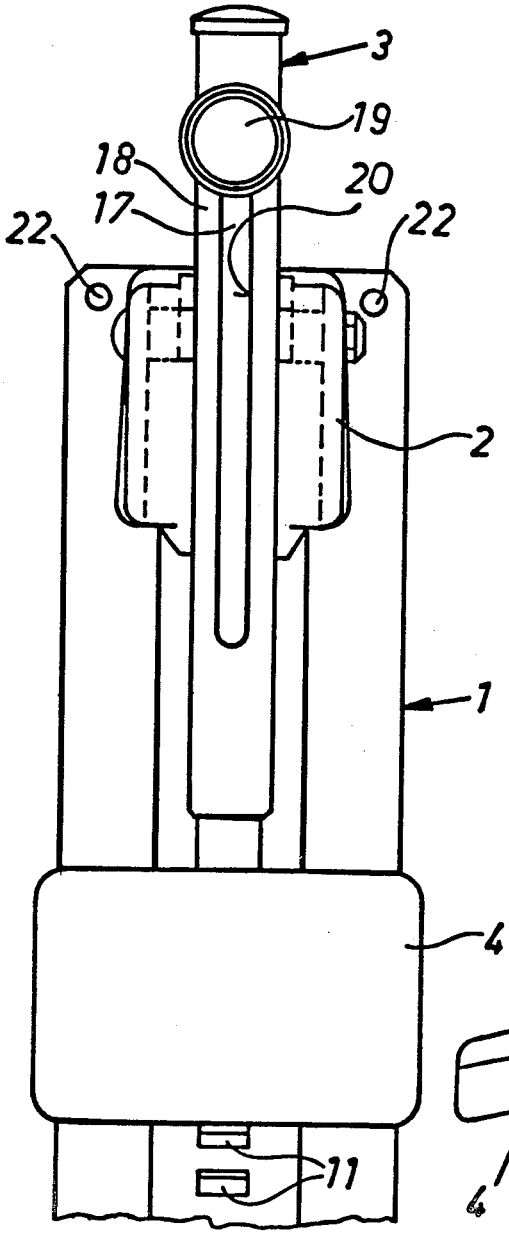
FIG. 5 is a front view of the device.

The device comprises a vertical rail 1, made for example of a plastic material and consisting of a mounting plate 1*a*, a guide plate 1*b*, and a flange 1*c*, forming together an H-shaped cross-section, as shown in FIG. 4. The mounting plate 1*a* comprises mounting holes 22, enabling it to be mounted by means of screws in a desired location on a wall.

Figures 1, 2:
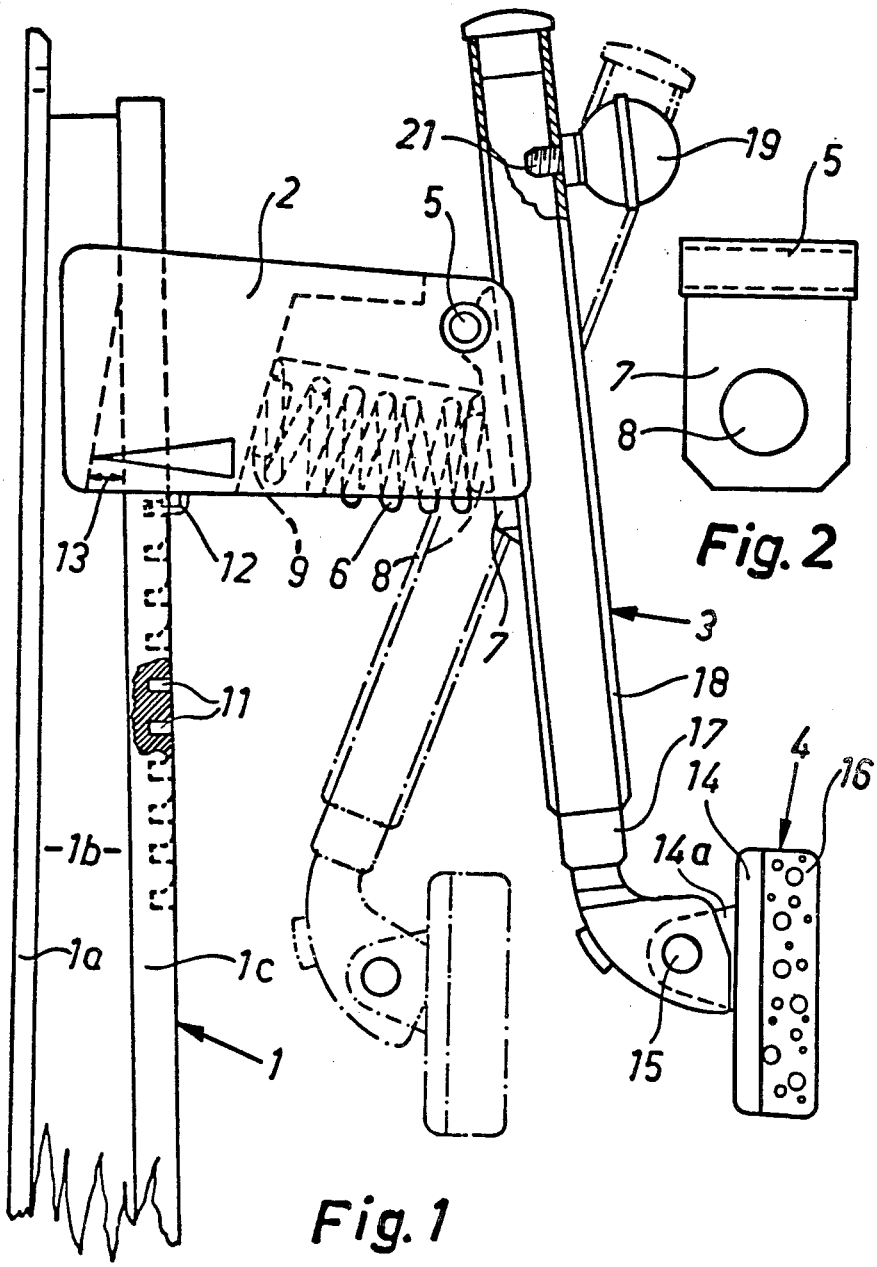
FIG. 1 is a side view of the device.
FIG. 2 is a view of the plate connecting the slider with the rocker arm.
Figure 6:
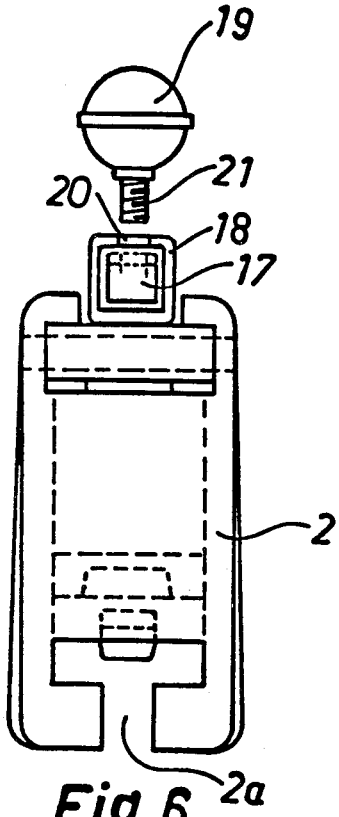
FIG. 6 is a top view showing the slider together with the rocker arm.
Figure 7:
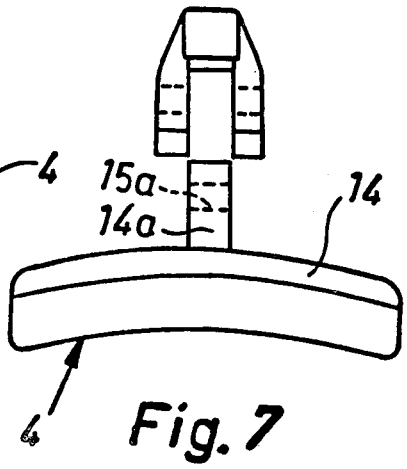
FIG. 7 is a top view showing the padded support.

A slider 2 is arranged to be slideable and fastenable on the rail 1 and to comprise a cutout 2*a* (FIG. 6) corresponding in shape to the cross-section of the flange 1*c* and the guide plate 1*b*; the slider 2 is guided within this cutout on rail 1. Toothing 11 is provided along the rail 1, a crossbar 12 disposed at the lower edge of the slider 2 being arranged to mesh and coact with the toothing. This connection may be loosened by tilting upwardly the end of the slider 2 which carries the crossbar, in a way to make the crossbar 12 come out of engagement with the toothing 11; this is made possible by the clearance space 13 (FIG. 1). In this tilted position the slider 2 may be displaced along the rail 1. Letting go of the slider 2 makes it automatically tilt back, by the force of gravity, into its locked position.

A rocker arm 3 is pivotably mounted by means of a tubular hinge 5 to the end of the slider 2 remote from the rail 1, and is subjected to the action of a compression spring 6, which endeavors to move the rocker arm from the position indicated by dash-dotted lines, into a position drawn in full lines. The compression spring is disposed between a bearing surface 10 of the slider 2 and a plate 7 mounted on the rocker arm 3. Cylindrical protrusions 8 and 9 are provided on the bearing surface 10 and the rocker arm 3, respectively, their function being to secure the compression spring against displacement. This facilitates installing and replacing the spring, when needed. At the same time, the plate 7 serves as mounting base for the hinge 5.

The rocker arm 3 may be lengthened or shortened in telescoping fashion. For this purpose it comprises an inner arm 17 axially movable within a tubular outer arm 18 of the rocker arm 3. The inner arm 17 has a clamping knob 19 screwed into it via a threaded pin 21. The threaded pin 21 penetrates through an oblong slot 20 of the outer arm 18. Rotation of the knob 19 in the proper direction unclamps the connection and results in displacement of the inner arm 17 relative to the outer arm 18. The inner arm 17 may be reclamped into position by tightening the knob 19. Lengthening the rocker arm 3 makes the effective lever arm longer, and the force required for tilting the rocker arm 3 against the action of the spring 6 smaller.

A support 4 is pivotable around a pivot axis 15, its pivotability being limited, to make the maximum pivoting movement correspond to the maximum angle of rotation of the rocker arm 3. The support 4 comprises a base plate 14 pivotably connected to the curved end of the inner arm 17 by means of a bracket 14*a* comprising a pivot bore 15*a*. A padding 16 consisting of cellular rubber, foam or the like and serving as neck or head support is provided on the other side of the base plate 14.

The function and the use of the device are described below. The length of the rocker arm 3 is set by means of the knob 19, in dependence of the magnitude of the desired force. Then the slider 2 is moved along the rail 1 mounted on the wall and set to the proper height, the support 4 to be arranged approximately at the eye level of the user. The user then turns his back against the device keeping his heels about 5 cm away from the wall, and leans the back of his head against the support 4. Holding now his body straight, his chin raised, his heels on the floor and his toes tight, he pushes against the support 4 with the back of his head, to tilt the rocker arm 3 against the force of the spring 6, into the outer position thereof. The rocker arm 3 is then held in this position for some length of time, such as eight seconds. This motion is repeated several times at each run, making sure to tighten the muscles responsible for the body posture, since these muscles get insufficiently or not at all exerted in customary sport and gymnastic exercises.

While there is shown and described a present preferred embodiment of the invention, it is to be distinctly understood that the invention is not limited thereto but may be otherwise variously embodied and practiced within the scope of the following claims. Accordingly,

What is claimed is:

1. A device for exercising the muscles determining body posture comprising:

a holding member formed of a vertical rail which is adapted to be mounted to a wall;

a protruding slider means having a bearing surface and a pivot for mounting a rocker arm, said slider means being movably and lockably guided along said vertical rail;

a support for pressing against the back of the head of the person using the exercising device;

a rocker arm which is arranged to carry said support and is mounted on said pivot of said slider means to be thereby carried by said holding member at the protruding end of said slider means;

a compression spring disposed between said bearing surface of said slider means and the said rocker arm, said compression spring being offset in the direction of said support in the region of the pivot for mounting said rocker arm; and adjustment means for said rocker arm whereby the length dimension of the rocker arm extending between the pivot mounting and the support is adjusted.

2. A device as claimed in claim 1 wherein said support comprises a base plate, a bracket carried on one side of a base plate by means of a hinge and a padding fastened to the other side of said base plate.

3. A device as claimed in claim 1 wherein said support is mounted to an end of the inner part of said rocker arm and said inner part of said rocker arm supports a clamping knob mounted thereto with a pin for locking the inner part of the rocker arm relative to the outer part of the rocker arm and a pin means arranged to protrude through a slot of said rocker arm.

4. A device as claimed in claim 1 wherein said holding member comprises a plate mounted to the wall and a guide plate protruding from the mounting plate with a flange disposed at one end of the guide plate remote from the mounting plate and said slider means has a shape corresponding to the cross section of the flange and said guide plate.

* * * * *